US008337321B2

(12) United States Patent
Bittner

(10) Patent No.: US 8,337,321 B2
(45) Date of Patent: Dec. 25, 2012

(54) PUTTING STROKE TRAINING SYSTEM

(76) Inventor: Norman Douglas Bittner, St. Helena Island, SC (US)

( * ) Notice: Subject to any disclaimer, the term of this patent is extended or adjusted under 35 U.S.C. 154(b) by 0 days.

(21) Appl. No.: 13/404,387

(22) Filed: Feb. 24, 2012

(65) Prior Publication Data

US 2012/0157218 A1 Jun. 21, 2012

Related U.S. Application Data

(60) Continuation-in-part of application No. 13/182,722, filed on Jul. 14, 2011, now Pat. No. 8,152,649, and a continuation-in-part of application No. 13/210,741, filed on Aug. 16, 2011, now Pat. No. 8,177,656, said application No. 13/182,722 is a division of application No. 12/268,231, filed on Nov. 10, 2008, now Pat. No. 8,002,643, said application No. 13/210,741 is a division of application No. 12/974,721, filed on Dec. 21, 2010, now Pat. No. 8,047,928, which is a continuation-in-part of application No. 12/268,231, filed on Nov. 10, 2008, now Pat. No. 8,002,643.

(60) Provisional application No. 61/449,112, filed on Mar. 4, 2011, provisional application No. 61/500,166, filed on Jun. 23, 2011, provisional application No. 61/524,079, filed on Aug. 16, 2011.

(51) Int. Cl.
*A63B 69/36* (2006.01)

(52) U.S. Cl. ..... 473/265; 473/409

(58) Field of Classification Search ..... 473/198–200, 473/219–226, 257, 407, 409
See application file for complete search history.

(56) References Cited

U.S. PATENT DOCUMENTS

| | | | |
|---|---|---|---|
| 2,090,348 | A | 8/1937 | Ferry |
| 2,995,376 | A | 8/1961 | Leo |
| 3,311,377 | A | 3/1967 | Holbus |
| 3,687,459 | A | 8/1972 | Swords |
| 3,885,796 | A | 5/1975 | King |
| 3,945,646 | A | 3/1976 | Hammond |
| 3,992,013 | A | 11/1976 | Golden |
| 4,137,566 | A | 1/1979 | Haas et al. |
| 4,155,555 | A | 5/1979 | Fink |
| 4,251,077 | A | 2/1981 | Pelz et al. |
| 4,254,956 | A | 3/1981 | Rusnak |
| 4,304,406 | A | 12/1981 | Cromarty |
| 4,341,384 | A | 7/1982 | Thackrey |
| 4,535,992 | A | 8/1985 | Slagle |
| 4,615,526 | A | 10/1986 | Yasuda et al. |
| 4,858,934 | A | 8/1989 | Ladick et al. |
| 4,958,836 | A | 9/1990 | Onozuka et al. |
| 4,962,931 | A | 10/1990 | Jazdzyk, Jr. |
| 4,971,325 | A | 11/1990 | Lipps |

(Continued)

OTHER PUBLICATIONS

U.S. Appl. No. 12/475,304, filed May 29, 2009.

*Primary Examiner* — Nini Legesse
(74) *Attorney, Agent, or Firm* — Nixon & Vanderhye P.C.

(57) ABSTRACT

A putting stroke training system includes a putting board with a putting section and a hole, a light sensitive or touch sensitive screen positioned in the putting section of the putting board, where the light sensitive or touch sensitive screen records stroke paths of a putter head, and a processor that correlates successful strokes with respective ones of the stroke paths. The processor generates a preferred stroke path based on an average of the successful strokes.

22 Claims, 6 Drawing Sheets

U.S. PATENT DOCUMENTS

| | | | | |
|---|---|---|---|---|
| 4,979,745 | A | 12/1990 | Kobayashi | |
| 5,020,802 | A | 6/1991 | af Strom | |
| 5,282,627 | A | 2/1994 | Beck | |
| 5,419,562 | A | 5/1995 | Cromarty | |
| 5,435,547 | A | 7/1995 | Lee | |
| 5,501,463 | A | 3/1996 | Gobush et al. | |
| 5,614,823 | A | 3/1997 | Katayama et al. | |
| 5,638,300 | A | 6/1997 | Johnson | |
| 5,685,782 | A | 11/1997 | Lipps et al. | |
| 5,907,819 | A | 5/1999 | Johnson | |
| 6,027,417 | A * | 2/2000 | Zoretic et al. | 473/407 |
| 6,095,928 | A | 8/2000 | Goszyk | |
| 6,287,215 | B1 | 9/2001 | Fisher | |
| 6,361,449 | B1 | 3/2002 | Holly | |
| 6,375,579 | B1 | 4/2002 | Hart | |
| 6,739,981 | B1 | 5/2004 | Lin | |
| 6,875,120 | B1 | 4/2005 | Ellis | |
| 6,913,544 | B2 | 7/2005 | Tiffin | |
| 7,232,375 | B1 | 6/2007 | Robert et al. | |
| 7,955,180 | B2 | 6/2011 | Bittner | |
| 8,002,643 | B2 | 8/2011 | Bittner | |
| 8,047,928 | B2 | 11/2011 | Bittner | |
| 2001/0005695 | A1 | 6/2001 | Lee et al. | |
| 2002/0077189 | A1 | 6/2002 | Tuer et al. | |
| 2005/0197198 | A1 | 9/2005 | Otten et al. | |
| 2006/0029916 | A1 | 2/2006 | Boscha | |
| 2007/0249428 | A1 | 10/2007 | Pendleton et al. | |
| 2008/0242437 | A1 * | 10/2008 | Taylor | 473/269 |

* cited by examiner

PUTTING STROKE TRAINING SYSTEM

CROSS-REFERENCES TO RELATED APPLICATIONS

This application claims the benefit of U.S. Provisional Patent Application Ser. No. 61/449,112, filed Mar. 4, 2011, U.S. Provisional Patent Application Ser. No. 61/500,166, filed Jun. 23, 2011, and U.S. Provisional Patent Application Ser. No. 61/524,079, filed Aug. 16, 2011, the entire contents of each of which are herein incorporated by reference.

This application is also a continuation-in-part (CIP) of U.S. patent application Ser. No. 13/182,722, filed Jul. 14, 2011, now U.S. Pat. No. 8,152,649 and a continuation-in-part (CIP) of U.S. patent application Ser. No. 13/210,741, filed Aug. 16, 2011, now U.S. Pat. No. 8,177,656, the entire contents of each of which are hereby incorporated by reference in this application.

U.S. patent application Ser. No. 13/182,722 is a divisional of U.S. patent application Ser. No. 12/268,231, filed Nov. 10, 2008, now U.S. Pat. No. 8,002,643, the entire contents of which is hereby incorporated by reference in this application.

U.S. patent application Ser. No. 13/210,741 is a divisional of U.S. patent application Ser. No. 12/974,721, filed Dec. 21, 2010, now U.S. Pat. No. 8,047,928; which is a continuation-in-part of U.S. patent application Ser. No. 12/268,231, filed Nov. 10, 2008, now U.S. Pat. No. 8,002,643, the entire contents of each of which are hereby incorporated by reference in this application.

STATEMENT REGARDING FEDERALLY SPONSORED RESEARCH OR DEVELOPMENT (NOT APPLICABLE)

BACKGROUND OF THE INVENTION

The invention relates generally to a device and method for training and analysis of a putting stroke and, more particularly, to a putting stroke training system including a putting board and electronic screens used for analyzing a putting stroke and for training.

For a golfer to be a good putter, the golfer must be able to control distance and direction with a putter. The golfer must also possess skills for "reading" a green. When "reading" a green, the golfer analyzes the terrain between the ball and the hole and determines the extent to which the ball will curve or "break" during the putt.

Golfers typically putt with a pendulum type swing using a shoulder turn. Other putting styles are also used, sometimes depending on the type and/or size of the putter. Regardless of the particular style used, it is critical to a successful putter that the golfer be capable of making a consistent stroke.

Training devices exist that purport to help golfers in achieving a consistent putting stroke. U.S. Published Patent Application No. 2006/0029916 A1 (Boscha) discloses a golf putter for training a golfer, where the golf putter has a handle, a head, and sensing unit for sensing parameters. U.S. Published Patent Application No. 2007/0249428 A1 (Pendleton, et al.) discloses a putting training device comprising a surface over which a golfer executes a putting stroke, an electric field generator, an electric field detector, and a plurality of electrodes responsive to the electric field generator each for producing an electric field. As the golfer executes the putting stroke, one or more of the electric fields is perturbed, and the electric field detector detects the perturbed electric field to determine parameters related to putter head movement. U.S. Pat. No. 6,375,579 B1 (Hart) discloses a dynamic laser based golf swing analysis system having single and multiple laser sources that broadcast a monochromatic laser light projected through a cylindrical lens system to generate a series of light planes in space. None of these prior devices adequately illustrates a putting stroke path to assist a golfer in making consistent and accurate putting strokes.

BRIEF SUMMARY OF THE INVENTION

Research has pointed out a fundamental misunderstanding of how a golfer should go about practicing putting. What has been happening traditionally is that a golfer repeatedly practices a putting stroke aiming at a cup, for example, some distance away. Some balls go in but about half just miss by a hair. The golfer does not know why. There is no benchmark or record. This is known in science as random behavior producing results from some unknown origin.

It is possible in present versions of software and touch screen technology to trace on a computer screen the path of the putting stroke. The putting motion must be consistent to ensure predictability of the putt. It does not matter to the golf ball if it has been stroked with a pendulum swing or a linear path motion. It is the replication of a grooved stroke that is important to produce contact with the ball consistently. The system of the described embodiments provides for putting on a board or screen with a recording device that informs the golfer all about the consistency of his strokes.

In an exemplary embodiment, a putting stroke training system includes a putting board with a stroke recording section and a result section. The stroke recording section records stroke paths of a putter head, and the result section records a result of each stroke of the putter head and identifies successful strokes. A stroke analysis tool correlates successful strokes with respective ones of the stroke paths recorded by the stroke recording section. The stroke analysis tool generates a preferred stroke path based on the respective ones of the stroke paths correlated with the successful strokes. An alignment tool includes a putting guide that graphically illustrates the preferred stroke.

The stroke recording section may include an electronic recording screen having one of a touch sensitive or light sensitive surface, where the electronic recording screen is coupled with a memory that stores the putter head stroke paths based on signals from the electronic recording screen. The stroke analysis tool may include a computer processor communicating with the electronic recording screen and the result section that selectively displays the preferred stroke on the electronic recording screen. The putting stroke training system may additionally include a scriber attachment for the putter head that includes a marking member detectable by the electronic recording screen. The scriber attachment may further include a signal emitter oriented in a direction substantially parallel to a surface of the putting board, where the stroke recording section has a signal receiver disposed facing the signal emitter during a putting stroke. The signal receiver may include a light sensitive electronic screen, where the signal emitter emits a signal that is detectable by the light sensitive electronic screen. The signal emitter and the signal receiver may be positioned to record a vertical position of the putter head during the putting stroke.

The result section may include an opening in a surface of the putting board that simulates a golf hole in a putting green, where the result section further includes a sensor that detects a ball in the opening. In this context, the result section may additionally include an electronic board that detects dynamic characteristics of a golf ball rolling over the electronic board, where the electronic board is positioned in front of the opening in the putting board surface.

The alignment tool is preferably portable and independent of the putting board. In one arrangement, the alignment tool includes a grid box with a bottom and two sides, where the putting guide is positioned inside the grid box on the bottom. The grid box may include a protractor at a putting end, and/or at least one of a side-to-side level and a front-to-back level. The bottom of the grid box may be formed of a transparent material. The grid box may also be provided with a metronome.

The stroke analysis tool may generate the preferred stroke path based on an average of a plurality of the stroke paths correlated with the successful strokes.

In another exemplary embodiment, a putting stroke training system includes a putting board with a putting section and a hole, a light sensitive or touch sensitive screen positioned in the putting section of the putting board, where the light sensitive or touch sensitive screen records stroke paths of a putter head, and a processor that correlates successful strokes with respective ones of the stroke paths. The processor generates a preferred stroke path based on an average of the successful strokes.

In accordance with yet another exemplary embodiment, a putting stroke training method includes the steps of (a) putting repeatedly on a surface including a stroke recording section; (b) recording stroke paths of a putter head via the stroke recording section; (c) correlating successful strokes with respective ones of the stroke paths; and (d) generating a preferred stroke path based on an average of the successful strokes. Step (b) may be practiced by recording the stroke paths in at least two dimensions.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
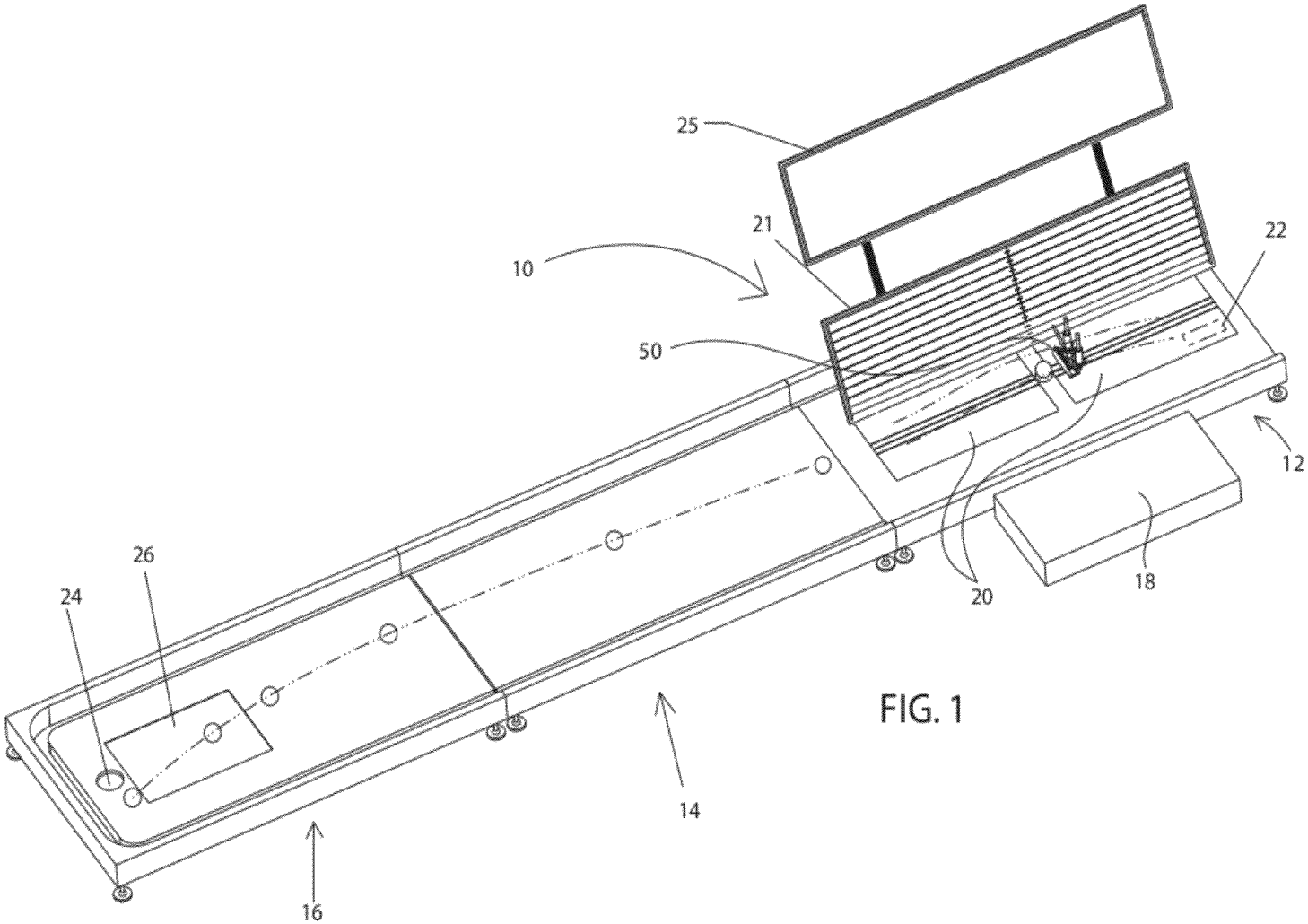
FIG. 1 is a perspective view of the putting stroke training system.

FIG. 1 is a perspective view showing the components of the putting stroke training system. The system includes a putting board 10 having a stroke recording section 12, a middle section 14 and a result section 16. The middle section 14 can be removed for simulating shorter putts, or additional middle sections may be added to extend the length of the putting board 10. In preferred embodiments, the putting board 10 can provide for putt lengths from 6-30 feet. A golfer stands on a platform 18 adjacent the putting board 10 during training and analysis. The platform 18 can be moved to either side to accommodate left-hand and right-hand swinging golfers.

The stroke recording section 12 serves to record stroke paths of a putter head 50. In a preferred construction, the stroke recording section 12 includes one or more electronic recording screens 20 embedded in the floor of the putting board. The electronic recording screens 20 may include one of a touch sensitive or light sensitive surface. The screens 20 serve to record the path of the putter head 50 as it is drawn back and through the ball and may also record the path of the ball after being struck by the putter head 50. The technology for the electronic recording screens 20 is known, and additional details of their structure and operation will not be further described. An exemplary recording screen is available from Perceptive Pixel of New York, N.Y. (www.perceptive-pixel.com).

The stroke recording section 12 may additionally include a signal receiver 21 preferably in the form of a screen or the like that is disposed facing the golfer during a putting stroke. The signal receiver 21 is cooperable with an attachment to the putter head (discussed in more detail below) to measure a vertical position of the putter head 50 during the putting stroke.

The electronic recording screen(s) 20 include or communicate with a memory 22 that digitally stores the putter head stroke paths based on signals from the electronic recording screen(s) 20.

The result section 16 records a result each stroke of the putter head 50 and identifies successful strokes. In one embodiment, the results section 16 includes an opening 24 in a surface of the putting board 10 that simulates a golf hole in a putting green. A sensor detects a ball in the opening. The result section 16 may also include an electronic board 26 that detects dynamic characteristics of a golf ball rolling over the electronic board 26. As shown in FIG. 1, the electronic board 26 in the results section 18 may be positioned in front of the opening 24 in the putting board surface. The putting board may also include a display screen 25 that can show a stroke path based on measurements from the recording screen(s) 20, or a comparison of a stroke path to a desired path, or video analysis based on characteristics of a detected stroke path, or multimedia instruction, etc.

Figure 5:
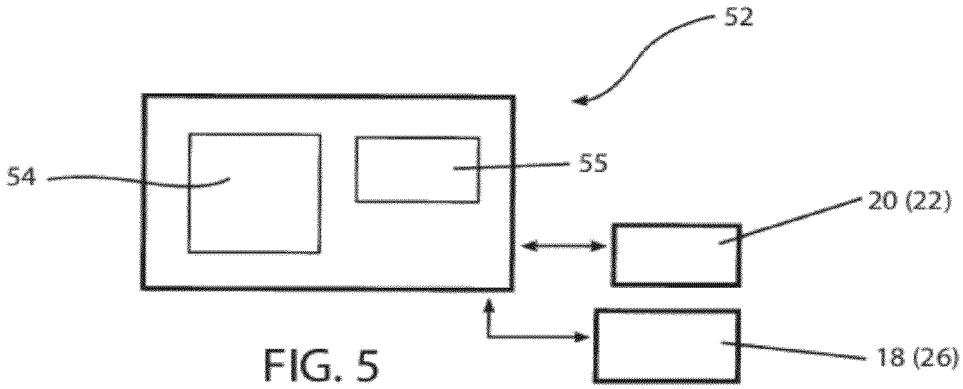
FIG. 5 is a schematic block diagram of the stroke analysis tool.

The system may additionally include a stroke analysis tool 52 (FIG. 5) that correlates successful strokes with respective ones of the stroke paths recorded by the stroke recording section 12. The stroke analysis tool 52 generates a preferred stroke path based on the respective ones of the stroke paths correlated with the successful strokes. In one embodiment, the stroke analysis tool 52 generates the preferred stroke path based on an average of a plurality of the stroke paths correlated with the successful strokes. In a preferred construction, with reference to FIG. 5, the stroke analysis tool 52 includes a computer processor 54 and memory 55 that communicate with the electronic recording screens 20, 26 and the results section 16. The computer processor 54 selectively displays the preferred stroke on the electronic recording screen(s) 20.

Figure 2:
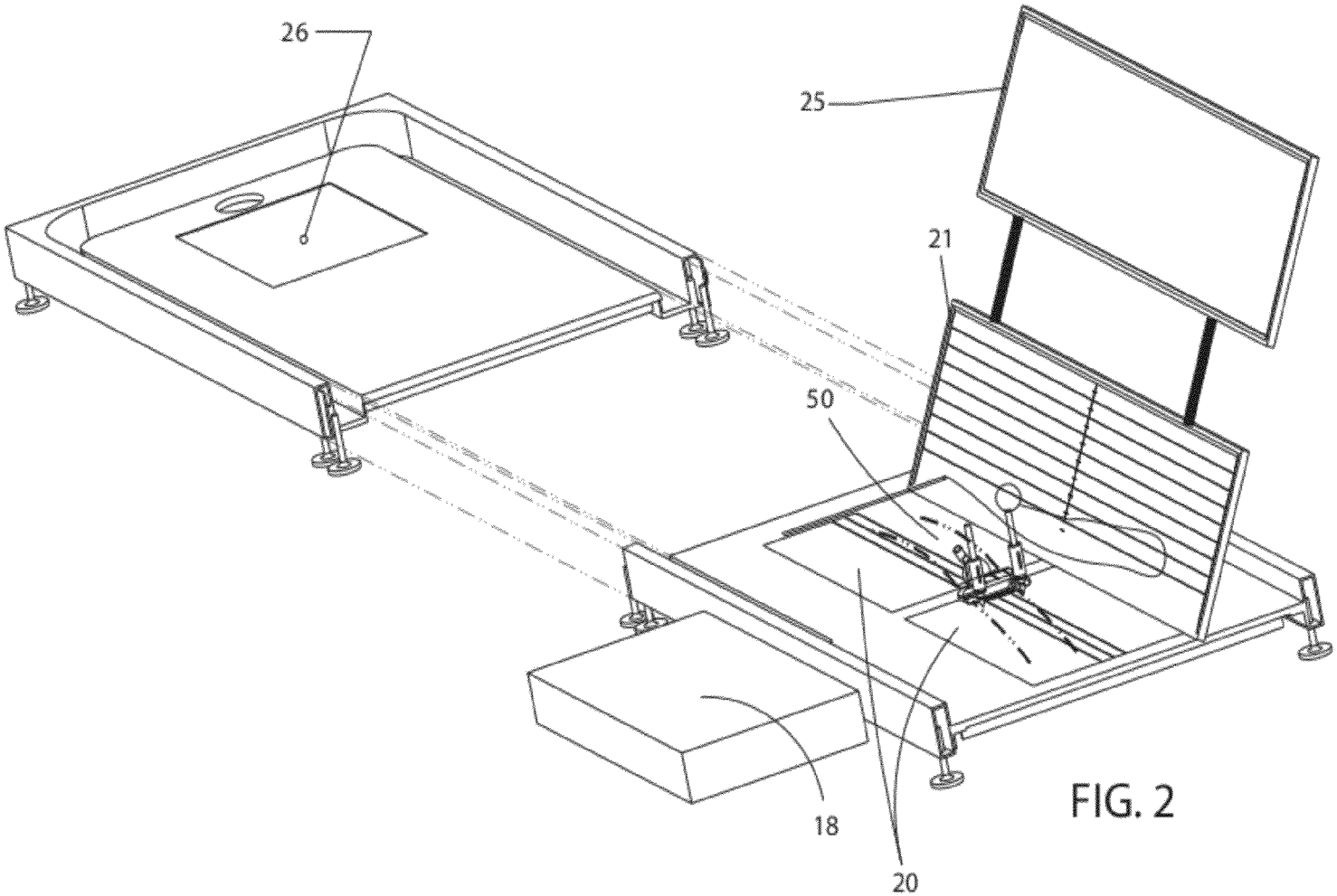
FIG. 2 shows the stroke recording section of the putting board.

With reference to FIG. 2, the putting stroke training system may additionally include an alignment tool such as grid box 28 that includes putting guide insert 30 that graphically illustrates the preferred stroke. The putting guide insert 30 is printed based on data measured by the stroke analysis tool 52. As such, the printed putting guide insert 30 is customized for each golfer based on each golfer's unique stroke. The alignment tool or grid box 28 is portable and independent from the putting board 10. The grid box 28 includes a bottom 32 and two sides 34 as shown, and the putting guide insert 30 is positioned inside the grid box 28 on the bottom 32. The bottom 32 may be made of a clear material such as acrylic or glass or the like so that with the grid box 28 on the putting board 10, the preferred stroke can be displayed on the electronic recording screen(s) 20 and viewed through the bottom 32 of the grid box 28. Also, when practicing on a real putting surface, the see-through bottom 32 will enable the golfer to better visualize the surface texture, color, etc. for more effective practice.

Preferably, the grid box 28 includes a protractor 36 at the putting end. The protractor 36 may be attached in the opposite orientation. Additionally, the grid box 28 may include one or both of a side-to-side level and a front-to-back level 38, which show an orientation of the grid box 28 on the green.

The levels 38 can be analog or digital, and a single level could be used to measure an orientation of the grid box in two dimensions. An analog level could also be put on a swivel so it can record both longitudinal and side-to-side inclinations of the putting green. The positions of the two readings can be related to the protractor 36. It may read, for example, 4° downward slope and 2° side hill slope. An index can be established that will determine the compensation in aiming the grid box 28. The index is representative of a variation in degrees from the norm of a straight putt on a flat surface. The resulting arithmetical reading on the protractor can indicate how much the grid box 28 should be repositioned in aim to compensate for the trajectory that the ball is going to have to travel in its path to the cup. Measurements of this type can lead to training a golfer to read greens with a higher percentage of accuracy.

Figure 3:
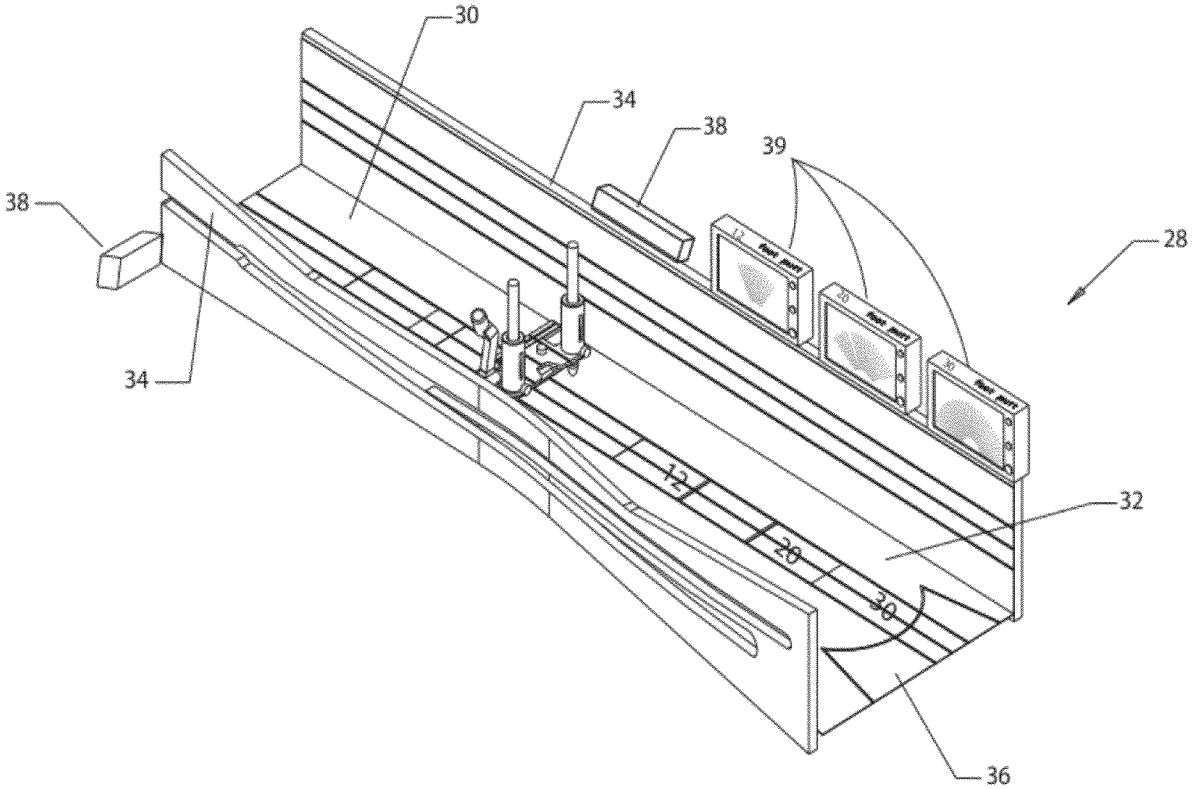
FIG. 3 shows an alignment tool in the form of a grid box that is cooperable with the putting board.

The grid box 28 may still also include one or more metronomes 39, which provide an audible and visual rhythm for the putting stroke. As shown in FIG. 3, the grid box 28 may be provided with three metronomes 39 with specific settings for putt lengths of 12, 20 and 30 feet, respectively. The metronomes 39 are preferably used in concert with drawback lines 40 included as part of the putting guide insert 30 in the grid box 28 (see FIG. 6). As shown, putting guide insert may also include guide lines 42 to facilitate putter head alignment using corresponding lines 44 on the putter head 50.

Figure 4:
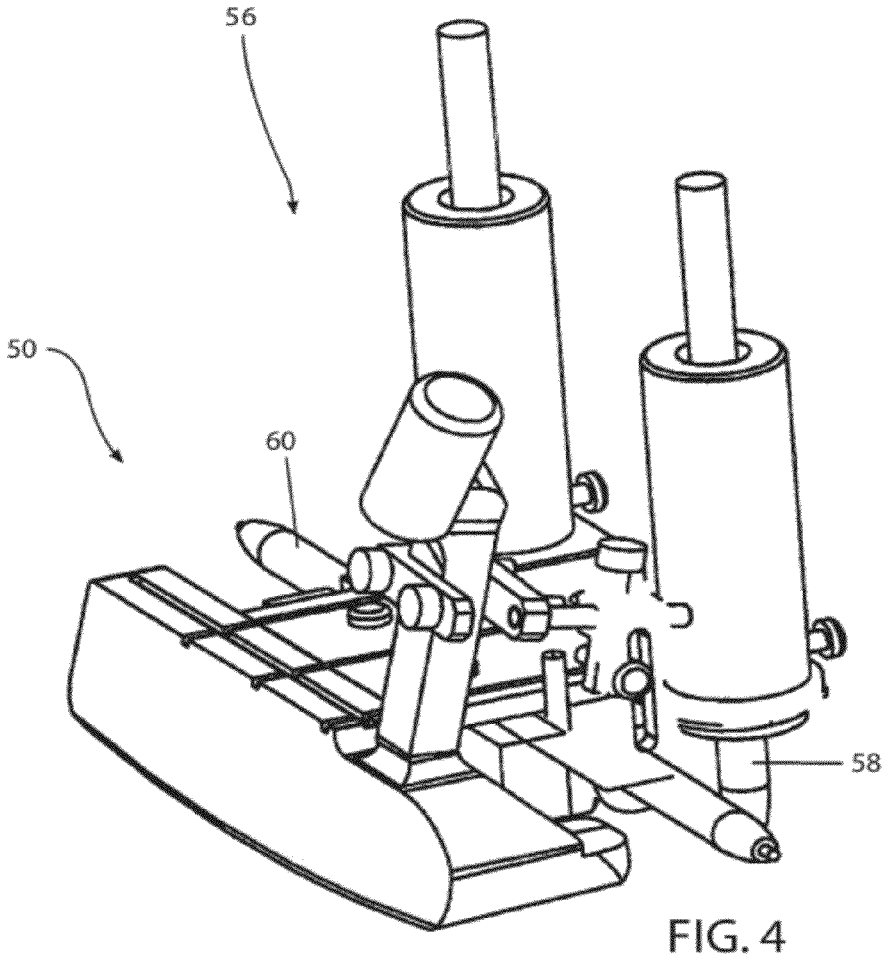
FIG. 4 is a perspective view of a putter head including a scriber attachment.

FIG. 4 is a perspective view of the putter head 50. The putter head 50 is fitted with a scriber attachment 56 including one or more marking members 58 that are detectable by the electronic recording screen(s) 20. The scriber attachment 56 also includes a signal emitter 60 that is oriented in a direction substantially parallel to a surface of the putting board 10 as shown. With continued reference to FIGS. 1 and 2, the signal receiver 21 is disposed facing the signal emitter 60 during a putting stroke. In a preferred construction, the signal receiver 21 comprises a light sensitive electronic screen, and the signal emitter 60 emits a signal that is detectable by the light sensitive electronic screen. The signal emitter 60 and the signal receiver 21 are positioned to record the vertical position of the putter head 50 during the putting stroke.

With the system assembled, a golfer begins training by standing on the platform 18 and making initial putts to familiarize the golfer with the system architecture. After the golfer is comfortable with putting directions, the recordings can begin for diagnostic purposes. Each putting motion is scribed on the board 10 and generated into a pattern that the stroke analysis tool 52 can synthesize into a mean or average motion relative to the success of the putts. Because the opening/hole 24 is able to record a successful putt, there can be a correlation between the putting pathway and the successful putt. Missed putts along with their putting pathways and attempts can be discarded. The number of successful putts is recorded and correlated with pathways generated by the putting stroke. At the end of testing, the stroke analysis tool 52 shows a line or an average of several lines that have been followed by the golfer's club that has produced the most successful number of putts. The scriber 56 records the putting pathway on the screen(s) 20. The stroke analysis tool 52 correlates the putter inscriptions with the number of successful putts recorded on the screen(s) 20. The software may be capable of predicting a successful putt by interpretations of inscribed pathways left on the electronic recording screen(s) 20.

When the preferred pathway for the successful putt has been selected, preferably based on an average pathway of successful putts, the preferred pathway is printed on an insert 30 for the grid box 28. At this point, the electronic recording screen 20 turns into a guidance system to be followed by the putter head 50. Repeatedly, the golfer executes putting attempts. The surface of the bottom 32 that is facing the golfer is thus inscribed with guidelines that show the golfer the preferred putting path. The printed lines guide the golfer to follow the lines with guide lines on the putter head 50 repeatedly until muscle memory is accomplished. During the phase using the screen 20 for guidance, there is once again a correlation between the recordings of successful putts with their pathways. During the training phase, it is especially desirable for the golfer to train his eye and muscle memory to follow the lines on the grid insert 30. For a beginning golfer or a golfer that struggles with putting and is looking to try a new stroke, the system may generate a suggested stroke pathway on the recording screen 20.

After aiming and putting, the golfer may see that the grid box 28 is aimed wrong, the golfer can record a miscalculation amount using the protractor 36, and the grid box 28 can be re-aimed. The protractor 36 tells the golfer in degrees how much the grid box 28 was off, which is important in gauging the break and ball direction as it approaches the cup. The grid box 28 may be adjustable in expansion to compensate for training someone who has a more accentuated pendulum and arced motion. This way, only one grid box is required when long (e.g., 30 feet) putts are attempted on today's larger greens.

Figure 6:
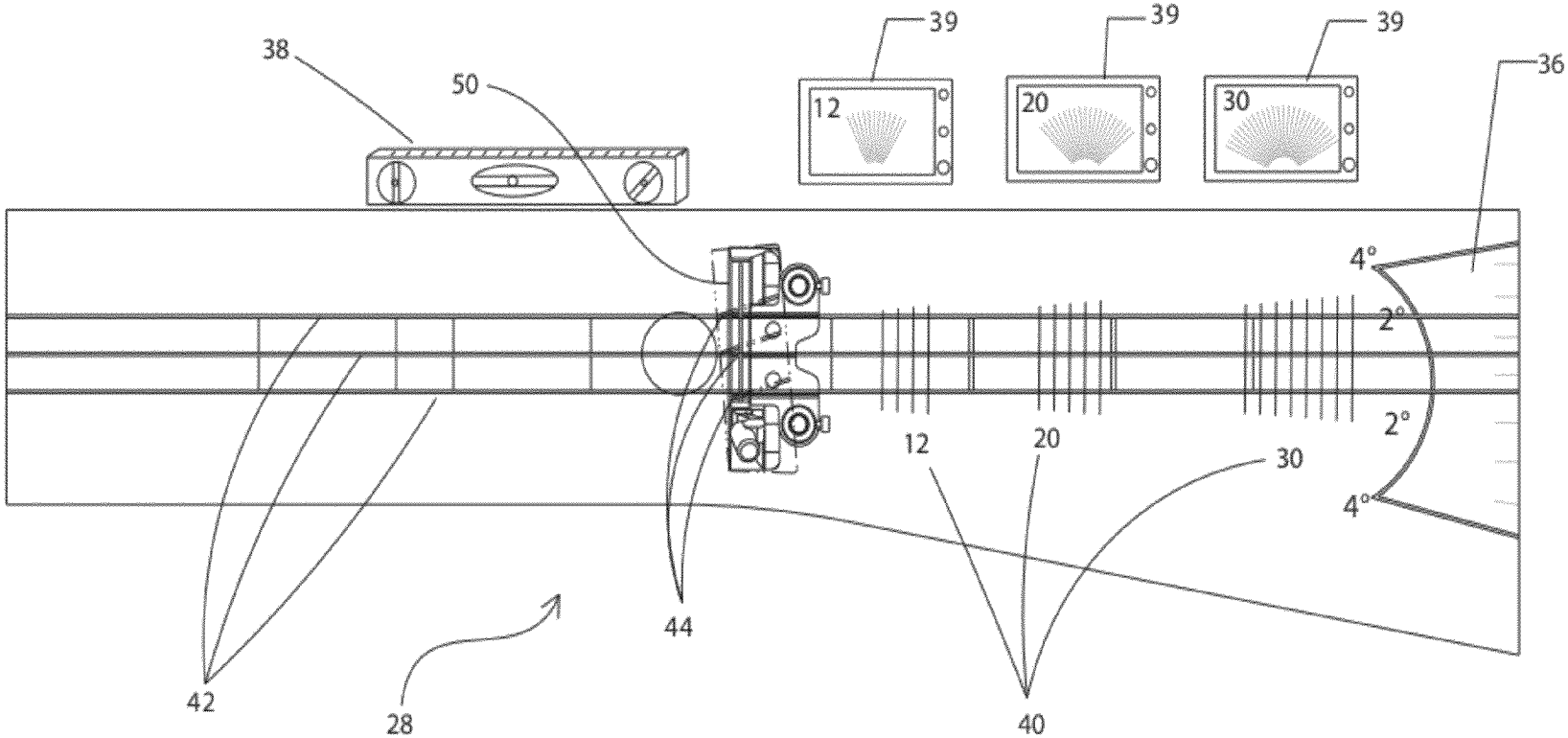
FIG. 6 shows additional details of the alignment tool.

The golfer continues to putt repeatedly trying to make any necessary corrections if the putter head 50 is wavering off the grid lines on the insert 30 that correspond to the preferred putting pathway. With reference to FIG. 6, regardless of the preferred putting pathway, an accurate putt requires that the face of the putter head 50 is perpendicular to the desired ball path at impact. The system can detect when the putter head is not perpendicular at impact (see dashed line putter head in FIG. 6) and provide an appropriate alert to the golfer. At this point, all strokes and attempts have been directed toward the opening/cup 24 on the typical length putting board 10, e.g., 12 feet. At a later time in training, when using the grid box 28, various new distances for putts can be memorized. After the ideal patterns for various putts are printed, a printout for the insert 30 is selected and placed in the grid box 28. The printout is preferably coordinated with a setting for the metronome 39.

For this occasion, a printout insert 30 for a putt of 12 feet is selected to be placed in the grid box 28. The recording screens 20 are now covered with a protective covering, and the grid box 28 is placed in the same location that the golfer was putting from during testing. The golfer then can putt from the grid box 28 for a few test putts. If the golfer is satisfied with the putting stroke, the golfer proceeds next to the grass outdoor putting green to find a level putt and putts from the grid box 28 with the printed guide insert 30 in place at a distance of 12 feet from the hole. The final phase includes putting without aides but with a grid box 28 moved just in front of the golfer's standing position. The grid box 28 thus serves as a reference point. Also, a return to the grid box 28 is recommended if putts are not successful.

The grid box 28 has become an important component of transference of knowledge from the computer diagnosis to the take home grid box. The printout guide insert 30 can be replaced on the floor of the grid box 28 after subsequent putting lessons if there are serious changes required for improved putting. The grid box 28 is coordinated with diagnostics from the stroke analysis tool 52 preferred putting pathway and is important to the procedure because it has the golfer take home results for training and practice in the golfers' grid box 28. Every student can utilize a grid box 28 with a unique printout insert 30, and as putting improves and the player is retested, and a new printout insert 30 can be provided. Additionally, there are numerous printout inserts 30 for different putt lengths.

Figure 7:
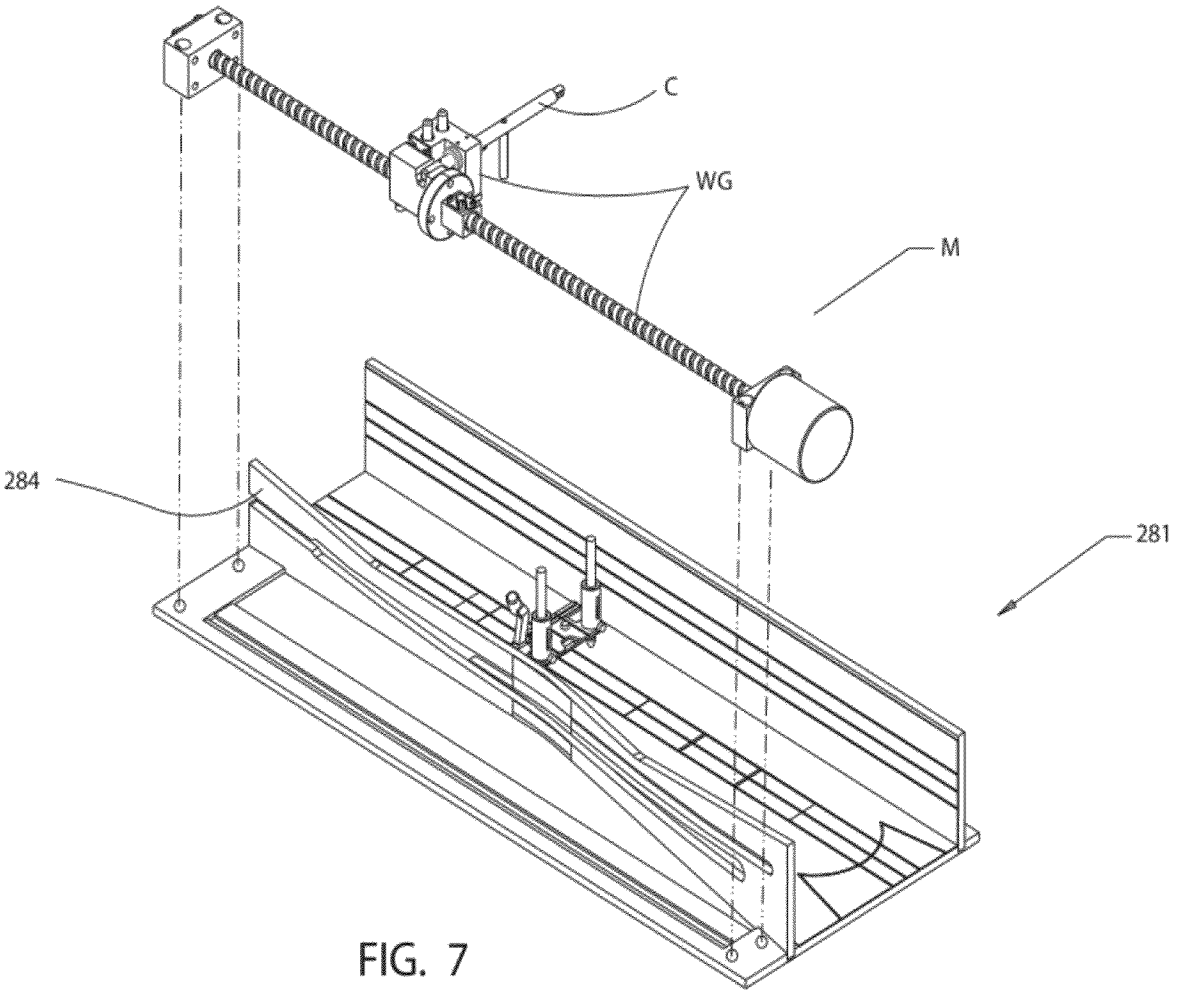
FIG. 7 shows a modified grid box including a robot assembly.

A summary of the preferred procedure:

A. The diagnosis of putting by the golfer on the putting board;

B. The recording of the preferred stroke related to performance on the putting board;

C. The training on the putting board to reinforce muscle memory following computer software guidance;

D. The printout insert for the grid box and training in the grid box for straight putts;

E. The printout insert from the computer is placed in the grid box, and training continues at various tilts of the putting board;

F. Re-aiming is taught on the putting board to compensate for putts with breaking curves in all directions in the grid box on the putting board;

G. The grid box is placed on a grass putting green and used as a guide for the putting stroke and for aiming including distance control, stroke accuracy, consistency, etc.; and H. The golfer becomes ready to putt now making judgment calls more proficiently for breaking putts;

With reference to FIG. 7, a modification of the grid box 281 includes the insertion of templates 284 in the side walls of the grid box. These can be replaced to duplicate the recordings made by the computer that replicate the golfer's preferred putting motion. A motor M can drive a worm gear WG assembly cooperable with a connector C that is coupled with the putter head. The speed of the motor is adjustable to create a proper rhythm and motion for the putt. The golfer passively holds on to the handle that is held in place by the connector. As the handle generates a putting path, the golfer in training will be able to memorize by way of muscle memory various types of putting strokes. In this way, the golfer can passively hold the handle of the club and have the club dictate a repeatable motion that over time can be memorized.

The concept of generation of a pathway by way of a matrix or a cam slot is to change the putting stroke from a questionable stroke into a repeatable, predictable and memorized stroke. Golfers by instinct have to on every occasion for a new putt make a new calculation on intensity and pathway for the putt in the one-time execution for critical performance. The concept can be reversed—i.e., the golfer should size up the conditions existing for a putt and then apply a memorized pattern to suit the circumstances, and this will help execute a more perfect putt.

The cam shaft/matrix concept can be generated by an assistant or an actual robotically adjustable electric motor attachment adjacent to the side of the grid box. Models of various complexities can be designed. The construction of the grid box with its interchangeable parts for a cam shaft allows for adjustments for various print-outs from the computer.

In an exemplary application, assume it is anticipated that in a ten foot putt, the ball will travel seven feet in a perfectly straight or linear path to a predetermined target before beginning to break or curve. At seven feet, the ball will begin to fade to the hole with a change in direction. The force of gravity from that point on is a deciding factor—the downhill direction that the ball follows to the cup as momentum of the ball slows. If properly stroked, the ball will diminish in speed in the last aspect of the putt gradually.

If a break amount of a putt is misjudged, a new aim is taken with the grid box, and the protractor is re-calibrated and the direction change recorded (e.g., rotated 7° clockwise so that the initial linear path of the ball is displaced from a center of the putting board). It is assumed for demonstration purposes that the re-aiming was successful. To re-aim, a new target was chosen. This is the green reading aspect for recording changes in aim and the skill of determining why and how a target was chosen. The screen 26 in front of the cup records where the ball has traveled to the opening/cup 24. There is a relationship back and forth with re-aiming and re-putting that develops the skill of reading the green. It is assumed the straight putt has become consistent and predictable before training begins for breaking putts.

The purpose of conducting this exercise on the putting board is to familiarize the golfer with the procedures that are going to be transferred to the putting green. Various putts of different breaks and distances can be estimated and tested on the green after training on the putting board. This method provides measurements and benchmarks for how much and where targets should be chosen for different putts and greens. The grid box is reinforcing the golfer's putting stroke with its direction and rhythm for the club and at the same time training and recording the aim for accuracy. Furthermore, a benchmark is established that records the accuracy of the first intended target. The adjustment on the putting board for various inclinations is controlled by its legs (see FIGS. 1 and 2) that are set in simple screw holders (telescoped legs can also be used).

The grid box should be carefully rotated as if there was an implanted swivel on the front end. The back end of the grid box is re-aimed and the protractor recorded to note the change. As the ball rolls across the green, a correlation with aim and judgment can be improved. When working with a coach, the golfer aims the grid box in the direction of where the ball is expected to begin its break and descent to the cup. The golfer keeps repeating putts to the target until achieving a successful result.

Using the system of the preferred embodiments, a golfer can identify a preferred putting stroke for repeatable successful putts. The system provides for a unique preferred putting pathway for each golfer based on inputs during the training phase. A printout placed in a take home grid box enables the golfer to establish muscle memory by practicing the preferred stroke over and over. The grid box can be used on the putting board, on a grass or artificial green, on the golfer's carpet, etc. Teachers can use the system to assist golfers in developing a consistent putting stroke, which is important to successful putting.

When a golfer ignores the hole on the green and only concentrates on his stroke on the putting grid, the objective is to train the golfer's muscles and coordination to have the golf club follow exactly back and forth over the lines on the grid box. Developing stroke and aim and consistency is significant. In fact, when the golfer looks at the aiming device on the putter head and examines the lines on the grid box, the golfer will see that errors repeatedly occur in direction and rotation of the club head. The shaft of the club is an extension of the fingered hand extending four feet out, so the slightest variations are magnified in club head movements.

When any waver or wobble occurs in the putting stroke, no successful putt can happen, without a lot of luck. Putting practice should begin after the preferred stroke is established by the computer in the grid box and should ignore the golf ball and the cup, and the golfer should develop a consistent stroke using the grid box.

Only when one's muscle memory is educated and a predictable stroke established should the grid box now be used to train drawback for a distance relative to the length of the putt. The distance to be putted is a separate issue and should be separated in one's mind from the attention directed for an accurate stroke.

The grid box enables the golfer to record/document errors and make alterations and corrections in the mind's eye and muscle behavior when practicing putting strokes. The recorded tracings delineate and explain the correlation between the aberrations in stroke and misjudgments in aim. Any other futile attempt to retry to sink putts randomly is counterproductive and arbitrarily doomed to failure without the use of benchmarks, guidelines and recording devices.

Without record keeping for a series of successful putts, it could still be a mystery why success or failure occurred. Going back on a subsequent day and not repeating success would be even more frustrating because there would be no explanation of why success occurred on one day and not on another. Frustrated golfers are infamous for their explanations of why one day they were so good and others so terrible. Recordings on an ongoing basis, using the guidelines on the club coordinated with the grid box guidelines, are the means to produce a consistent outcome for successful putting because eventually muscle memory rhythm, distance judgment and other factors will become a habit.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A putting stroke training system comprising:

a putting board including a stroke recording section and a result section, the stroke recording section recording stroke paths of a putter head made by a golfer using the system, and the result section recording a result of each stroke of the putter head and identifying successful strokes of the golfer;

a stroke analysis tool that correlates successful strokes with respective ones of the stroke paths recorded by the stroke recording section, the stroke analysis tool generating a preferred stroke path for the golfer based on the respective ones of the stroke paths correlated with the successful strokes; and an alignment tool including a putting guide that graphically illustrates the preferred stroke path.

2. A putting stroke training system according to claim 1, wherein the stroke recording section comprises an electronic recording screen having one of a touch sensitive or light sensitive surface, the electronic recording screen being coupled with a memory that stores the putter head stroke paths based on signals from the electronic recording screen.

3. A putting stroke training system according to claim 2, wherein the stroke analysis tool comprises a computer processor communicating with the electronic recording screen and the result section, the computer processor selectively displaying the preferred stroke on the electronic recording screen.

4. A putting stroke training system according to claim 3, further comprising a scriber attachment for the putter head, the scriber attachment including a marking member detectable by the electronic recording screen.

5. A putting stroke training system according to claim 4, wherein the scriber attachment further includes a signal emitter oriented in a direction substantially parallel to a surface of the putting board, and wherein the stroke recording section comprises a signal receiver disposed facing the signal emitter during a putting stroke.

6. A putting stroke training system according to claim 5, wherein the signal receiver comprises a light sensitive electronic screen, and wherein the signal emitter emits a signal that is detectable by the light sensitive electronic screen.

7. A putting stroke training system according to claim 6, wherein the signal emitter and the signal receiver are positioned to record a vertical position of the putter head during the putting stroke.

8. A putting stroke training system according to claim 1, wherein the result section comprises an opening in a surface of the putting board that simulates a golf hole in a putting green, the result section further comprising a sensor that detects a ball in the opening.

9. A putting stroke training system according to claim 8, wherein the result section further comprises an electronic board that detects dynamic characteristics of a golf ball rolling over the electronic board, the electronic board being positioned in front of the opening in the putting board surface.

10. A putting stroke training system according to claim 1, wherein the alignment tool is portable and independent of the putting board.

11. A putting stroke training system comprising:

a putting board including a stroke recording section and a result section, the stroke recording section recording stroke paths of a putter head, and the result section recording a result of each stroke of the putter head and identifying successful strokes;

a stroke analysis tool that correlates successful strokes with respective ones of the stroke paths recorded by the stroke recording section, the stroke analysis tool generating a preferred stroke path based on the respective ones of the stroke paths correlated with the successful strokes; and an alignment tool including a putting guide that graphically illustrates the preferred stroke path, wherein the alignment tool comprises a grid box including a bottom and two sides, and wherein the putting guide is positioned inside the grid box on the bottom.

12. A putting stroke training system according to claim 11, wherein the grid box comprises a protractor at a putting end.

13. A putting stroke training system according to claim 11, wherein the grid box comprises at least one of a side-to-side level and a front-to-back level.

14. A putting stroke training system according to claim 11, wherein the bottom of the grid box is formed of a transparent material.

15. A putting stroke training system according to claim 11, wherein the grid box further comprises a metronome.

16. A putting stroke training system according to claim 1, wherein the stroke analysis tool generates the preferred stroke path based on an average of a plurality of the stroke paths correlated with the successful strokes.

17. A putting stroke training system comprising:

a putting board including a putting section and a hole;

a light sensitive or touch sensitive screen positioned in the putting section of the putting board, the light sensitive or touch sensitive screen recording stroke paths of a putter head made by a golfer using the system; and a processor that correlates successful strokes with respective ones of the stroke paths, the processor generating a preferred stroke path for the golfer based on an average of the successful strokes.

18. A putting stroke training system comprising:

a putting board including a putting section and a hole;

a light sensitive or touch sensitive screen positioned in the putting section of the putting board, the light sensitive or touch sensitive screen recording stroke paths of a putter head; and a processor that correlates successful strokes with respective ones of the stroke paths, the processor generating a preferred stroke path based on an average of the successful strokes; and a grid box cooperable with the putting board, the grid box including a putting guide that graphically illustrates the preferred stroke path.

19. A putting stroke training system comprising:

a putting board including a putting section and a hole;

a light sensitive or touch sensitive screen positioned in the putting section of the putting board, the light sensitive or touch sensitive screen recording stroke paths of a putter head; and a processor that correlates successful strokes with respective ones of the stroke paths, the processor generating a preferred stroke path based on an average of the successful strokes; and a scriber attachment for the putter head, the scriber attachment including a marking member detectable by the light sensitive or touch sensitive screen.

20. A putting stroke training system according to claim 19, wherein the scriber attachment further includes a signal emitter oriented in a direction substantially parallel to a surface of the putting board, the putter stroke training system further comprising a signal receiver disposed facing the signal emitter during a putting stroke.

21. A putting stroke training method comprising:

(a) a golfer putting repeatedly on a surface including a stroke recording section;

(b) recording stroke paths of a putter head via the stroke recording section;

(c) correlating successful strokes by the golfer with respective ones of the stroke paths;

and (d) generating a preferred stroke path for the golfer based on an average of the successful strokes.

22. A method according to claim 21, wherein step (b) is practiced by recording the stroke paths in at least two dimensions.

* * * * *